United States Patent [19]

Riffe et al.

[11] Patent Number: 4,547,131

[45] Date of Patent: Oct. 15, 1985

[54] REFRIGERATION COMPRESSOR AND METHOD OF ASSEMBLING SAME

[75] Inventors: Delmar R. Riffe; John P. Elson; Dilip S. Sathe; Walter T. Grassbaugh, all of Sidney, Ohio

[73] Assignee: Copeland Corporation, Sidney, Ohio

[21] Appl. No.: 516,772

[22] Filed: Jul. 25, 1983

[51] Int. Cl.[4] ..... F04B 35/04; B23P 15/00

[52] U.S. Cl. ..... 417/53; 417/410; 417/415; 417/902; 29/156.4 R; 29/464; 310/89; 310/90

[58] Field of Search ..... 417/53, 312, 360, 410, 417/415, 902, 419; 29/156.4 R, 434, 464; 92/128; 310/89, 90

[56] References Cited

U.S. PATENT DOCUMENTS

| | | | |
|---|---|---|---|
| 1,949,505 | 3/1934 | Warren | 417/410 X |
| 2,745,169 | 5/1956 | Scheldorf | 417/415 X |
| 2,752,088 | 6/1956 | Borgerd et al. | 417/902 X |
| 2,787,824 | 4/1957 | Kaczor | 29/434 X |
| 2,862,656 | 12/1958 | Kadison | 417/415 X |
| 2,871,793 | 2/1959 | Michie et al. | 417/410 X |
| 3,031,861 | 5/1962 | McCormack | 417/312 X |
| 3,476,308 | 11/1969 | Rundell et al. | 417/415 |
| 3,526,942 | 9/1970 | Monden et al. | 29/156.4 R |
| 3,872,562 | 3/1975 | Pestel | 29/156.4 R |
| 3,992,133 | 11/1976 | Brunner | 417/372 X |

FOREIGN PATENT DOCUMENTS

| | | | |
|---|---|---|---|
| 822393 | 11/1951 | Fed. Rep. of Germany | 417/415 |
| 1106917 | 5/1961 | Fed. Rep. of Germany | 417/415 |
| 136161 | 11/1978 | Japan | 29/464 |
| 68586 | 4/1982 | Japan | 417/360 |

*Primary Examiner*—William L. Freeh
*Assistant Examiner*—Paul F. Neils
*Attorney, Agent, or Firm*—Harness, Dickey & Pierce

[57] ABSTRACT

A method of assembling a hermetic refrigeration motor compressor is disclosed wherein the motor stator is assembled in a first shell section, the compressor is assembled in another shell section and the two shell sections are aligned and secured together in such a manner as to insure a uniform air gap between the rotor and stator. The method employed enables the two shell sections to be initially locked in position before complete welding of the periphery so as to avoid potential heat distortion.

11 Claims, 22 Drawing Figures

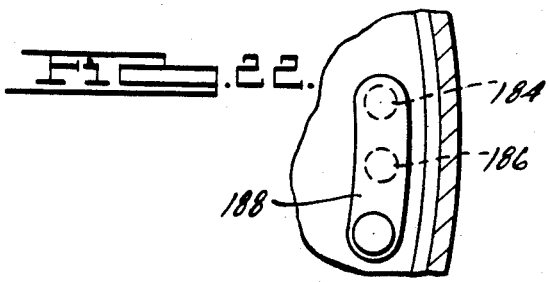
FIG. 22.
FIG. 21.
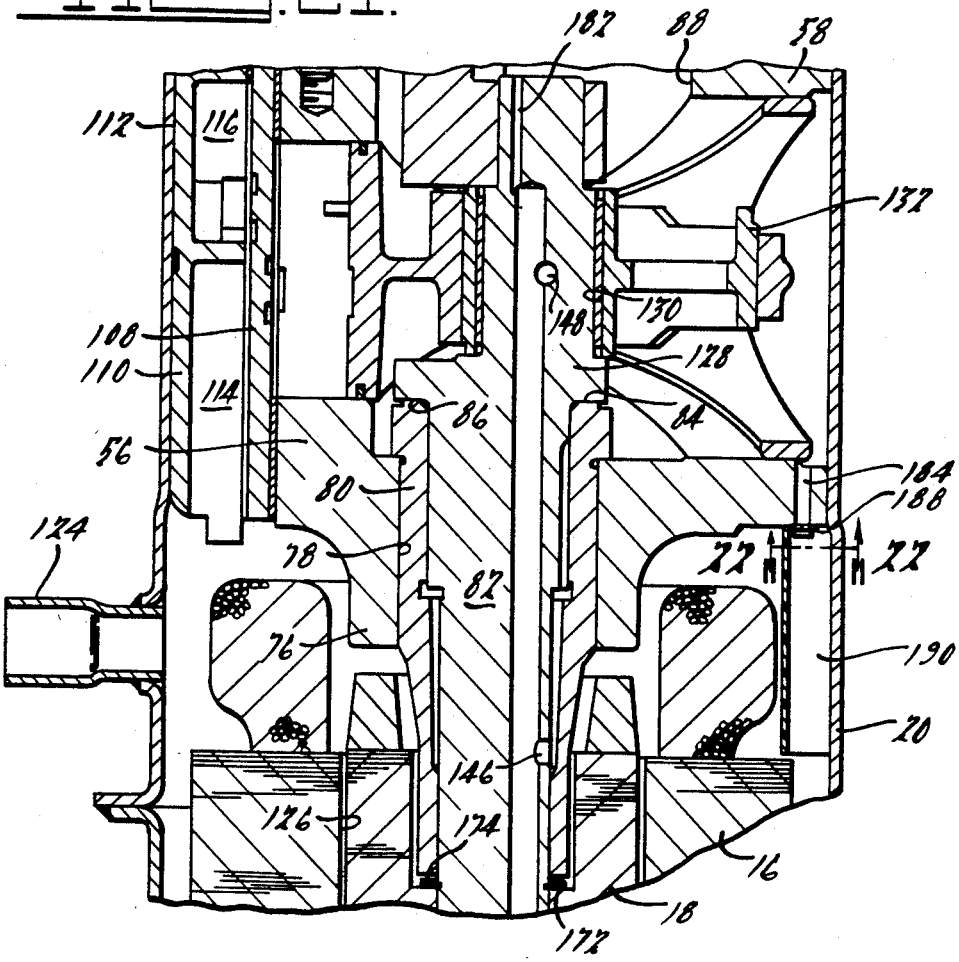
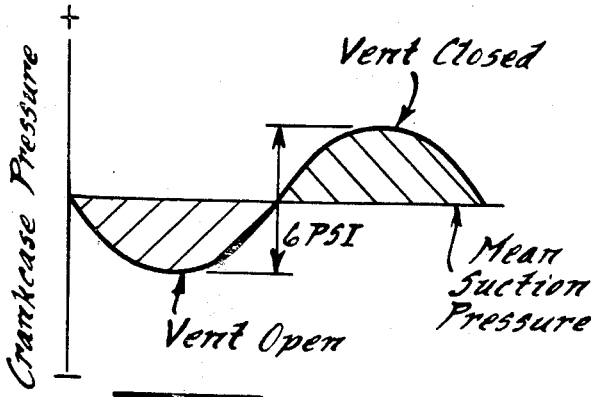
FIG. 16.
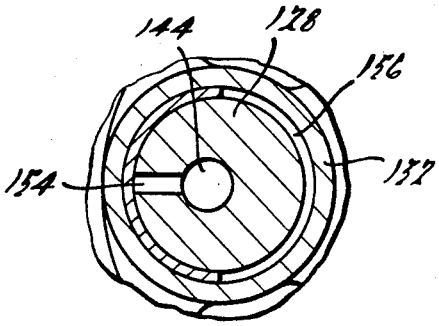
FIG. 15.

REFRIGERATION COMPRESSOR AND METHOD OF ASSEMBLING SAME

BACKGROUND AND SUMMARY OF THE INVENTION

The present invention relates generally to compressors and more particularly to reciprocating refrigeration compressors of the hermetically sealed type.

Hermetic refrigeration compressors are utilized in a wide variety of residential and commercial applications. In all of these applications the compressors are required to provide reliable operation over an extended period of time with little or no maintenance and as economically as possible. In order to provide reliable, economical, maintenance free operation for long periods of time, it is highly desirable to design a compressor which has as few parts as possible and which may be easily manufactured and assembled and is as compact as possible.

The present invention provides a compressor of the reciprocating piston hermetically sealed type which offers a unique approach to accomplishing the above often conflicting objectives. In the present invention, the compressor assembly and stator are each independently and directly supported by the outer shell thereby eliminating the need for separate support members which also aids in simplifying assembly thereof. Also, the compressor assembly is designed to utilize the outer shell to retain the head and valve assembly in assembled relationship with the compressor body thereby almost entirely eliminating the need for separate fasteners.

A unique, simple and straightforward cam drive arrangement is also provided which offers significant improvement in the operating efficiency of the compressor by providing a longer time period for exhausting compressed refrigerant from the cylinder as compared with compressors employing substantially more complicated scotch yoke drive arrangements. Additionally, the cam drive mechanism is able to provide this increased discharge time with a cam member which acts as a combination wrist pin and connecting rod and which is received within an opening in the piston.

Thus, the maximum size of the compressor may be reduced to be no greater than the diameter of the stator, thereby enabling the assembly to be placed in a relatively small circular shell. Also, the use of a one piece piston and connecting rod further reduces the number of parts required as well as the associated assembly time.

An improved discharge muffler is also incorporated in the present compressor which has an inlet directly connected to the compressor housing thereby eliminating the need for separate tubing to conduct discharge gas thereto from the compression chamber. The discharge muffler also forms a part of the outer shell and because the compressor is rigidly supported by the shell, it is possible to provide a direct outlet connection for supplying compressed refrigerant to other components of the refrigeration system.

A unique method of assembling the present invention is also disclosed wherein the compressor and stator are assembled in separate shell sections which are then accurately positioned and secured together in a manner which substantially avoids any distortion thereof due to heating from welding. The method of assembly also includes a method of selecting a head gasket of suitable thickness to insure positive sealing of the head and valve assembly to the compressor body upon press fitting thereof into the shell.

In order to assure positive and sufficient lubrication of the present invention, one embodiment incorporates a rotary valve which selectively places the upper end of an axially extending oil passage in communication with a substantially closed crankcase so as to create a pressure differential within the oil passage to aid in flow of lubricant therethrough. In another embodiment, the oil passage is in continuous communication with the crankcase which is vented to the interior of the shell through pressure responsive valved openings. Thus, the cyclic low pressures resulting from reciprocal movement of the compressor operate to assist flow of oil through the axially extending passage.

Thus, the present invention provides a remarkably unique and novel compressor which offers the advantages of low cost assembly and improved reliability due to the substantial reduction in the number of parts required, an extremely compact design and efficiencies of operation not previously attainable in compressors of comparable size.

Additional advantages and features of the present invention will become apparent from the subsequent description and the appended claims taken in conjunction with the accompanying drawings.

BRIEF DESCRIPTION OF THE DRAWINGS

FIG. 15 is a fragmentary section view of the upper portion of the crankshaft of the motor compressor shown in FIG. 1;

FIG. 16 is a graph showing the pressure fluctuations within the crankcase of the motor compressor of FIG. 1 as a result of reciprocating movement of the piston;

FIG. 21 is a fragmentary section view of a portion of a motor compressor in accordance with the present invention showing an alternative means for venting the crankcase thereof; and FIG. 22 is an enlarged fragmentary section view of the crankcase venting arrangement shown in FIG. 21, the section being taken along line 22—22 thereof.

DESCRIPTION OF THE PREFERRED EMBODIMENTS

Figure 1:
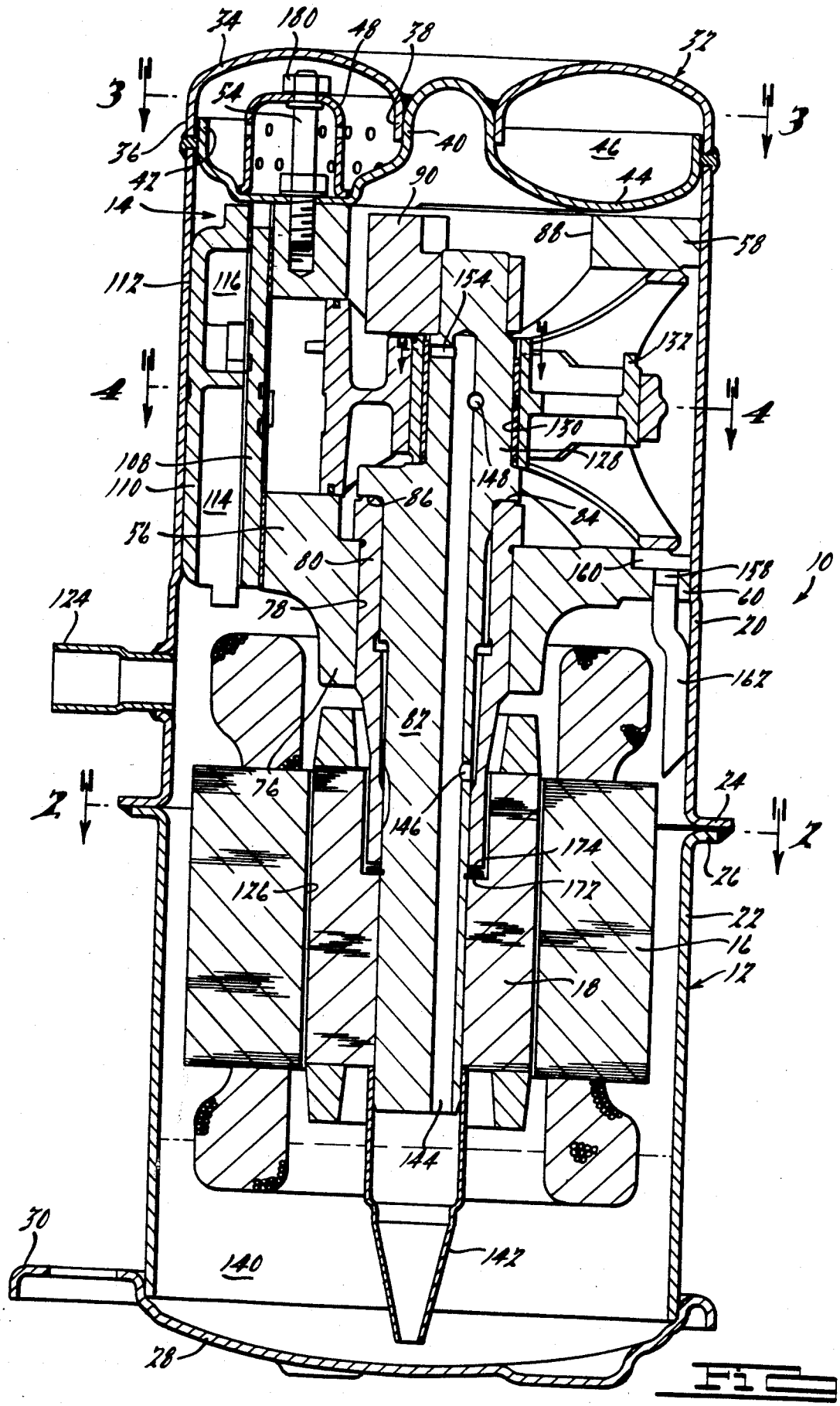
FIG. 1 is a vertical sectional view of a hermetic motor compressor in accordance with the present invention.
Figure 2:
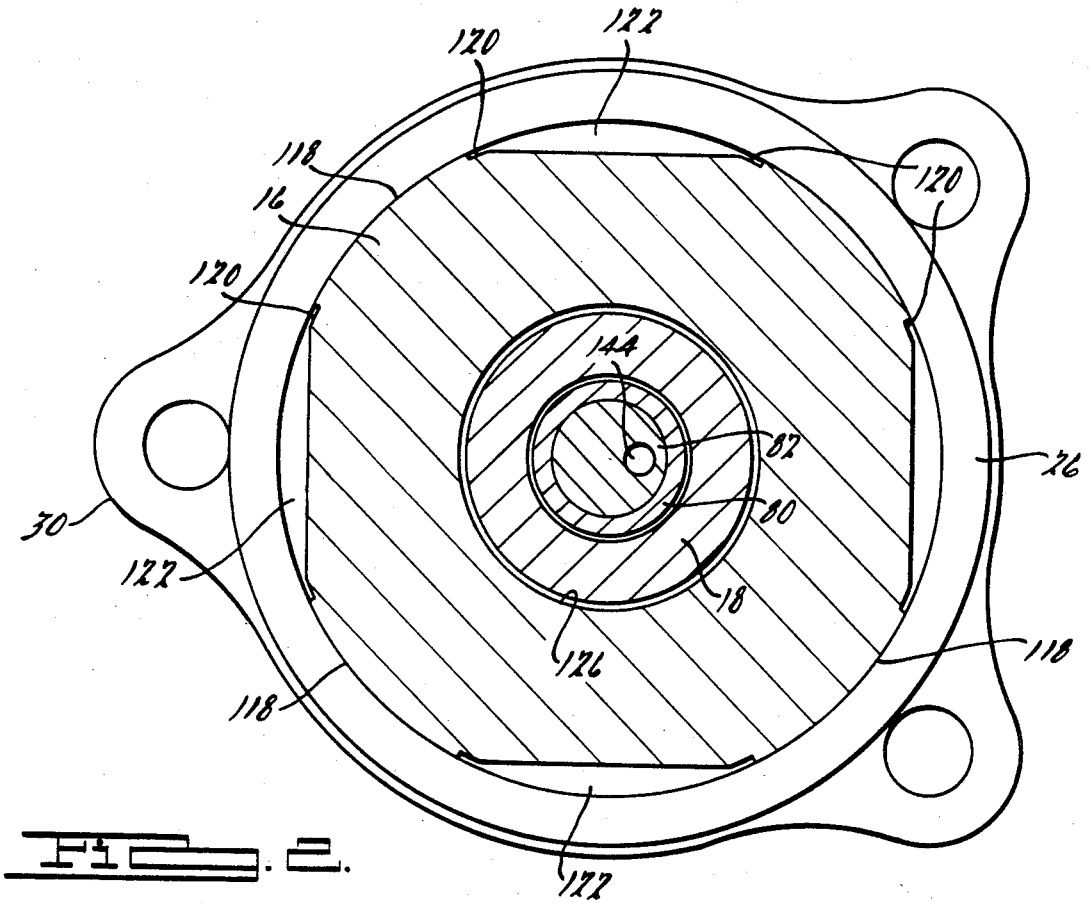
FIG. 2 is a section view of the motor compressor shown in FIG. 1, the section being taken along line 2—2 thereof.
Figure 3:
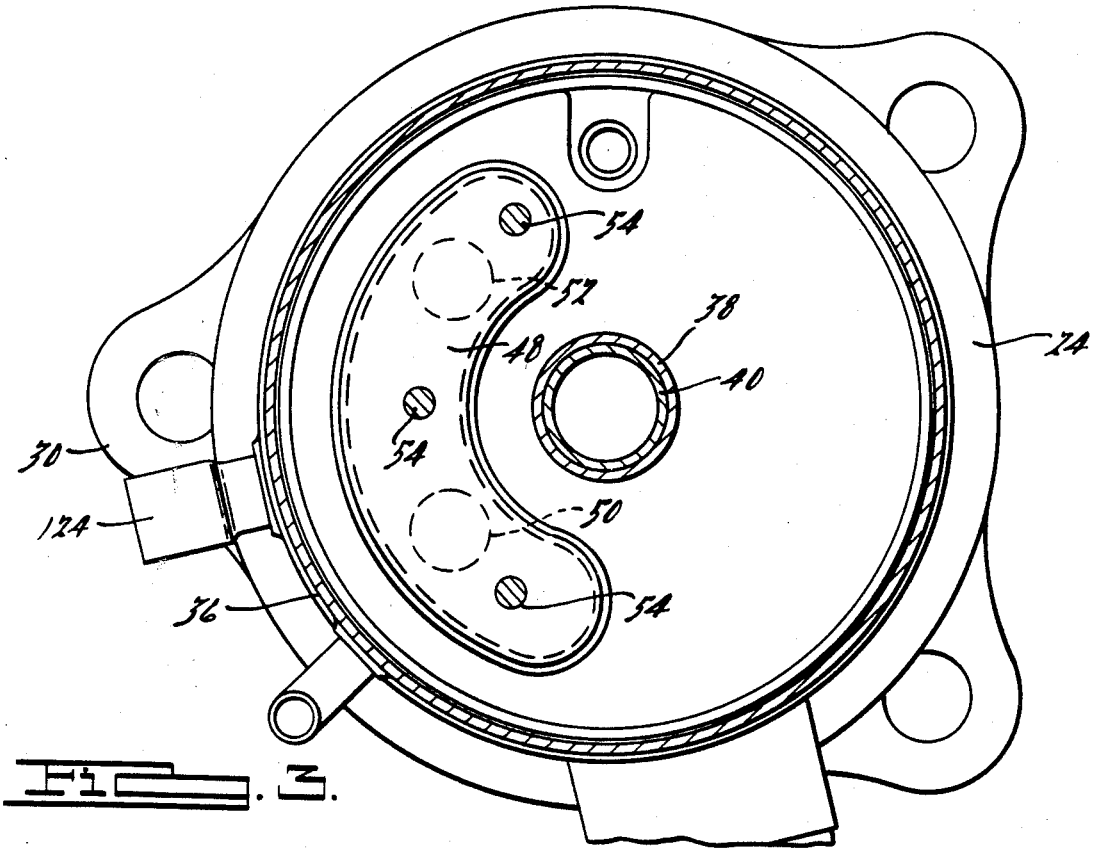
FIG. 3 is a section view of the motor compressor shown in FIG. 1, the section being taken along line 3—3 thereof.
Figure 17:
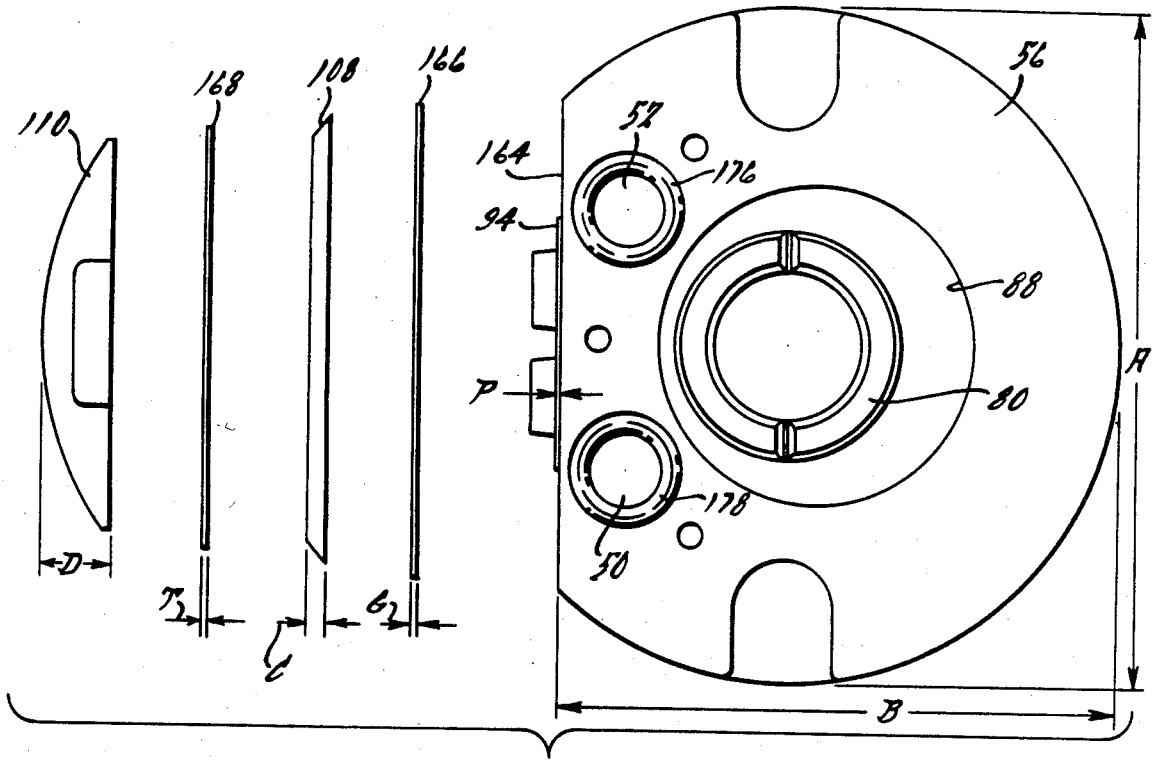
FIG. 17 is a fragmentary exploded plan view of a portion of the compressor assembly shown in FIG. 1 illustrating a method of selecting a head gasket therefor, all in accordance with the present invention.

Referring now to the drawings and in particular to FIGS. 1 through 15, there is shown a hermetic motor compressor in accordance with the present invention illustrated generally at 10.

Motor compressor 10 comprises a hermetically sealed, multi-piece outer shell 12 within which are independently supported a compressor assembly 14 drivenly connected to a motor including stator 16 and rotor 18.

Multipiece shell 12 includes upper and lower elongated generally circular shaped sections 20 and 22 each of which is provided with a generally radially outwardly extending flange portion 24 and 26 respectively adapted to be secured in generally abutting relationship. The lower end of lower cylindrical section 22 has secured thereto a bottom portion 28 which incorporates a plurality of circumferentially spaced mounting feet 30 integrally formed therewith and extending generally radially outwardly therefrom.

A discharge muffler 32 is secured to the upper end of upper cylindrical portion 20 and forms the closure for the top end of shell 12. Discharge muffler 32 comprises an annular shaped member 34 having inner and outer peripheral flanges 36 and 38 secured in overlapping relationship with radially inner and outer flange portions 40 and 42 of a lower member 44 so as to form an annular noise attenuating cavity 46 therebetween. An arcuate shaped baffle member 48 of a generally inverted U-shape in cross section is secured within cavity 46 in overlying relationship to a pair of spaced discharge gas inlet openings 50 and 52 by means of a plurality of threaded fasteners 54.

As best seen with reference to FIG. 1, threaded fasteners 54 also operate to secure lower member 44 to compressor 14. Compressor 14 includes a main body 56 defined in part by spaced upper and lower generally circularly shaped flange portions 58 and 60 which are interconnected by a pair of substantially parallel mirror imaged chordally extending sidewall walls 62 and 64 and a cylinder wall 66 extending substantially perpendicularly therebetween.

Figure 4:
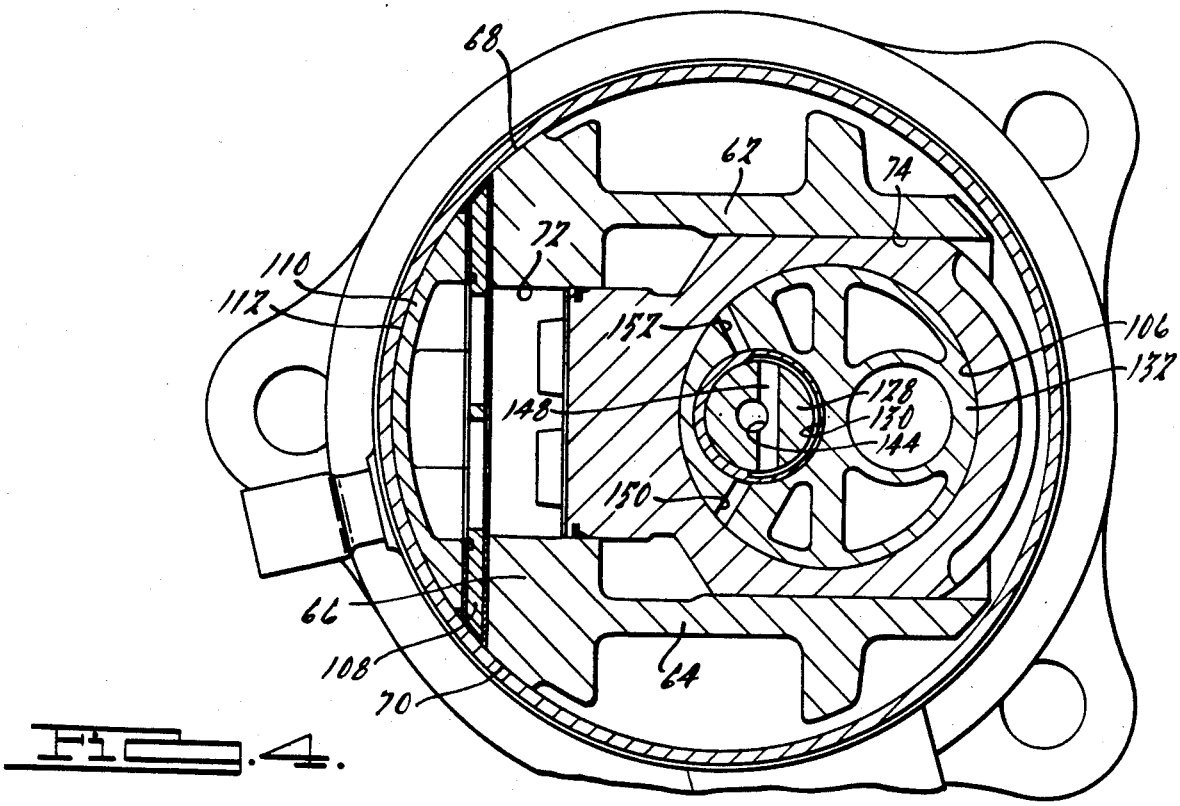
FIG. 4 is also a section view of the motor compressor shown in FIG. 1, the section being taken along line 4—4 thereof.
Figure 5:
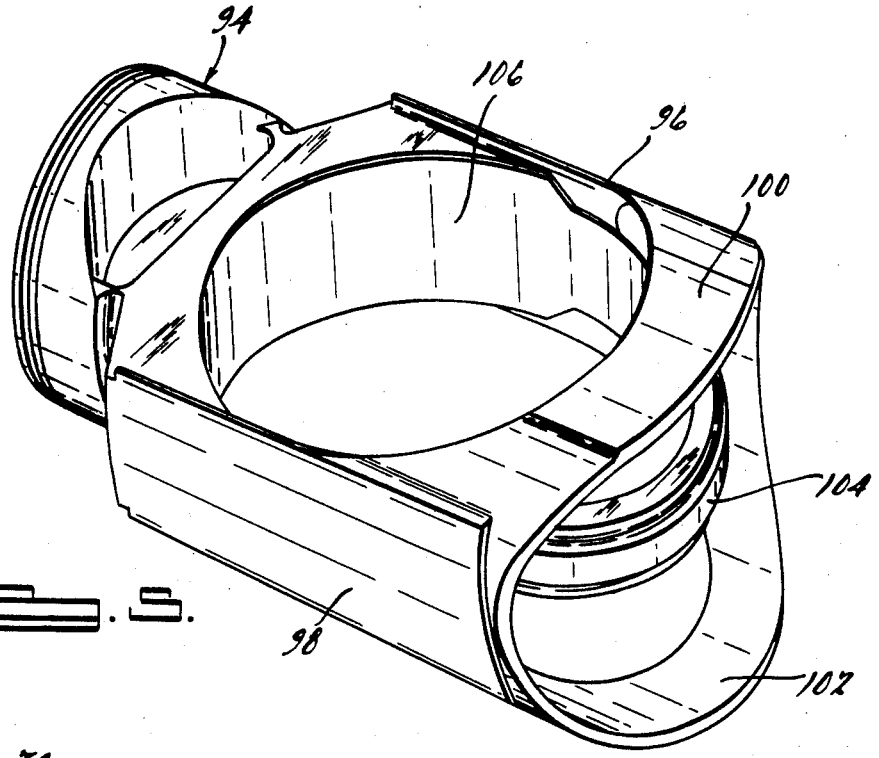
FIG. 5 is a perspective view of the piston utilized in the motor compressor of FIG. 1.
Figure 20:
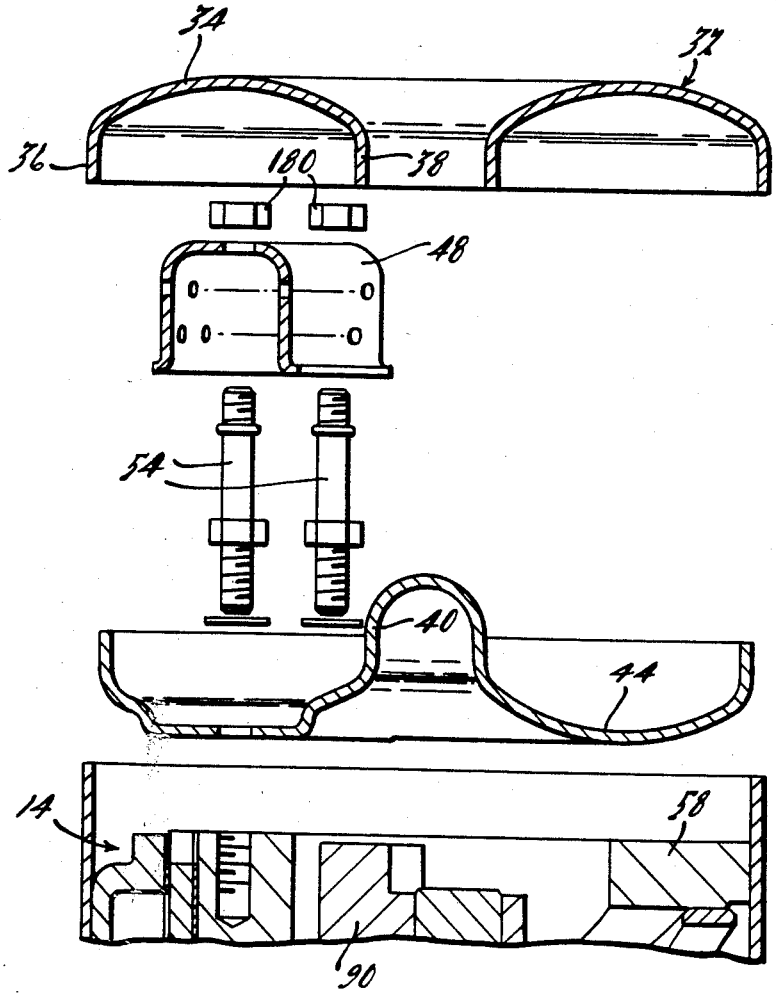
FIG. 20 is a fragmentary exploded section view of the motor compressor of FIG. 1 showing the method of assembling the discharge muffler incorporated therein.

As shown in FIG. 4, cylinder wall 66 includes arcuately shaped surfaces 68 and 70 at opposite ends thereof designed to matingly engage the inner periphery of upper shell section 20 and cooperate with lower flange portion 60 and lower member 44 of discharge muffler 32 to define a substantially closed crankcase. A cylinder defining bore 72 extends through cylinder wall 66 which is positioned in coaxial diametrically opposed relationship with an enlarged diameter bore 74 defined by sidewalls 62, 64 and upper and lower flange portions 58 and 60 respectively.

Lower flange portion 60 has a generally conically shaped depending portion 76 defining an opening 78 therethrough which is adapted to receive an elongated stepped bearing 80 within which a crankshaft 82 is rotatably journaled. As seen in FIG. 1, bearing 80 includes an axial thrust bearing shoulder 84 engageable with an annular shoulder 86 provided on crankshaft 82. A relatively large diameter opening 88 extends through flange 58 and is positioned coaxially with opening 78 and accommodates the rotation of a counterweight 90 pressfitted on an extension of a crankshaft 82.

A piston 94 is reciprocatingly disposed within cylinder 72 and includes an irregularly shaped integrally formed connecting portion for drivingly connecting piston 94 to crankshaft 82 which inclues a pair of generally parallel elongated spaced sidewalls portions 96 and 98, the outer surfaces of which are cylindrically contoured to mate with the sidewall of the enlarged diameter bore 74 within compressor housing so as to laterally support and guide reciprocating movement of piston 94. A pair of curved arms 100, 102 extend rearwardly and respectively upwardly and downwardly between sidewalls 96 and 98 the outer surfaces of which are also cylindrically contoured and adapted to matingly engage the sidewalls of enlarged diameter bore 74 to further aid in supporting and guiding reciprocating movement of piston 94. An arcuately shaped strap portion 104 extends between sidewalls 96 and 98 intermediate arms 100 and 102 and cooperate with sidewalls 96 and 98 to define a relatively large diameter journal 106 for drivenly interconnecting piston 94 with crankshaft 82. Strap portion 104 may be relatively narrow so as to reduce the weight of piston 94 without sacrificing reliability as it extends around the unloaded side of the connecting portion. Similarly, because vertically directed side loading on piston 94 is relatively light, arms 100 and 102 may be substantially smaller in cross section than sidewalls 96 and 98.

A valve plate assembly 108 and head 110 are positioned in overlying relationship to the radially outer end of cylinder 72. As best seen in FIG. 4, the radially outer surface 112 of head 110 has an arcuate shape complimentary to the shape of the upper shell section and is designed to be securely retained against the compressor housing thereby without requiring any separate fasteners. Additionally, as shown, valve plate assembly 108 extends chordally between the sidewalls of shell portion 20 and cooperates with head 110 to substantially prevent leakage between the crankcase and the lower interior of outer shell 12. Included within head 110 are a suction chamber 114 which communicates with the motor compartment via an opening in the lower end thereof to supply suction gas therefrom to cylinder 72 and a discharge chamber 116 for receiving discharge gas from cylinder 72 and conducting it through openings 50 and 52 to the discharge muffler 32. Of course the valve plate includes suitable ports and valving for controlling the fluid flow into and out of cylinder 72.

Motor stator 16 is designed to be pressfitted or heat shrunk into and supported solely by the lower shell section 22 and accordingly has a generally rectangular cross sectional shape with the corners 118 thereof being radiused to matingly engage the sidewalls of lower shell section 22. In order to prevent undue stress and possible distortion of the shape of shell section 22, relief notches 120 are provided in the periphery of the stator at each of the intersections between the radiused portions and planar sidewalls. The resulting spaces 122 between stator 16 and shell section 22 intermediate surfaces 118 enable suction gas to circulate therearound so as to cool the motor entering through suction inlet 124 in shell section 22.

Thus, as disclosed, motor compressor 10 includes a compressor assembly 14 which is directly supportingly secured within an upper shell section 20 and a motor stator 16 directly supportingly secured within a lower shell section 22 and completely independently of the other. In order to drive compressor assembly 14, rotor 18 is pressfitted or heat shrunk onto the lower end of crankshaft 82 and positioned within central bore 126 of stator 16.

A unique cam drive arrangement is employed in motor compressor 10 to transform the rotational driving forces imparted to crankshaft 82 by the motor into reciprocating motion of the piston. This unique cam drive arrangement enables the cylinder and head assembly to be maintained within the generally cylindrical confines defined by the motor stator while affording even greater time for exhausting of discharge gas than is typically achieved by substantially longer connecting rod piston drives or scotch yoke drive arrangements. As shown in FIG. 1, crankshaft 82 includes a eccentric 128 which is received within an eccentic opening 130 of a cam member 132 which in turn is received within bore 106 of piston 94.

Figure 6:
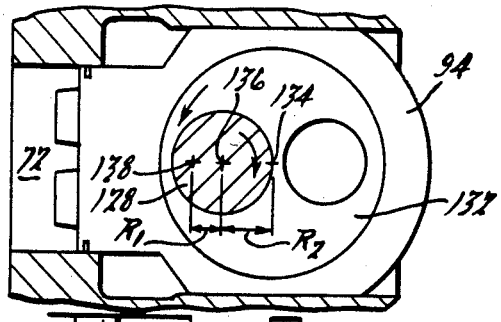
FIGS. 6 through 13 are schematic representations illustrating in sequence the operation of the driving assembly incorporated in the hermetic motor compressor of FIG. 1, all in accordance with the present invention.
Figure 11:
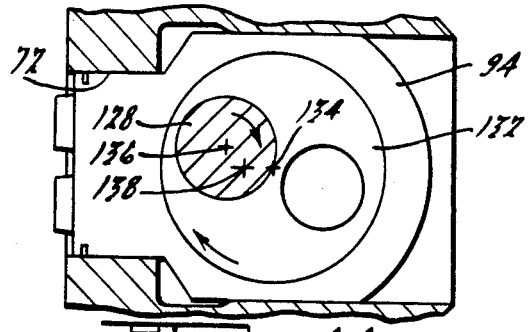
Figure 7:
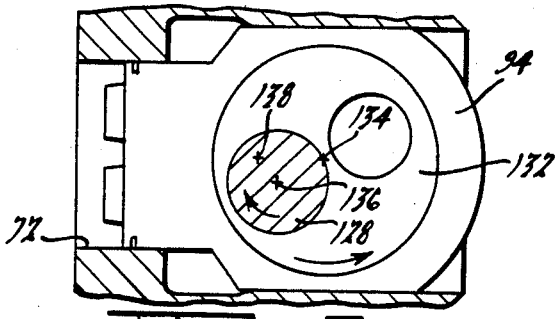
Figure 12:
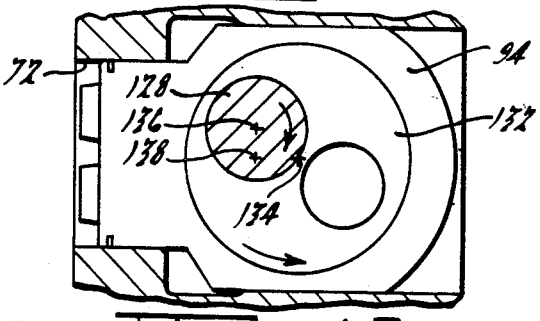
Figure 8:
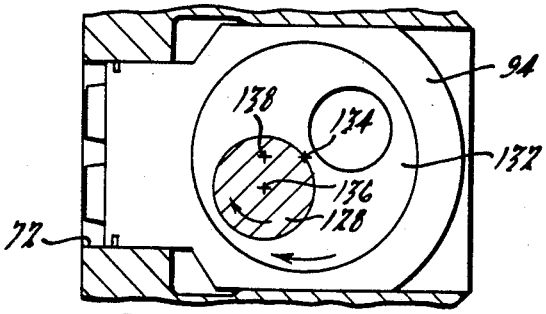
Figure 13:
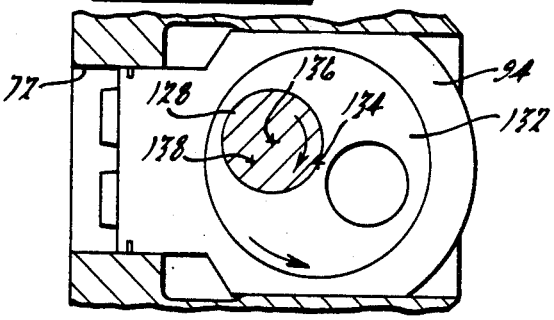
Figure 9:
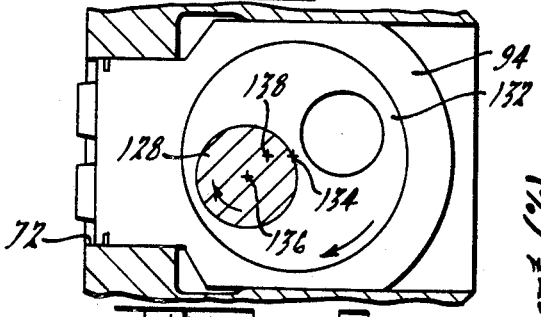
Figure 10:
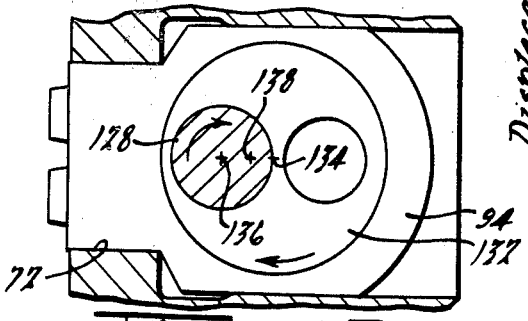

The operation of this cam drive arrangement is illustrated and will be explained with reference to FIGS. 6 through 13. As shown in FIG. 6, piston 94 is at bottom dead center. In this position, the axis 134 of rotation of the cam 132, the axis 136 of the crankshaft eccentric 128 and the axis 138 of rotation of the crankshaft 82 will all be aligned along the line of movement of piston 94 with axis 132 of the cam being furthest from the cylinder 72 and the axis 136 of the eccentric 136 being between the axis 134 of the cam 132 and the axis 138 of the crankshaft 82. As crankshaft 82 is rotationally driven in a clockwise direction as shown the axis 136 of crankshaft eccentric 128 is moved laterally out of alignment. Because cam member 132 is restrained against any lateral movement by piston 94, it will initially be rotationally driven in a couterclockwise direction to accommodate this lateral displacement of crankshaft eccentric 128. As crankshaft 82 continues to rotate in a clockwise direction, cam member 132 will rotate in a counterclockwise direction until maximum lateral displacement of axis 136 of crankshaft eccentric 128 has been reached, which as shown in FIG. 8, occurs at 90° of rotation beyond bottom dead center. At this point cam member 132 will reverse its direction of rotation and begin rotating in a clockwise direction because the lateral displacement of axis 136 of the eccentric 128 will be decreasing. Thus, both the crank eccentric 128 and cam member 132 will rotate in the same direction until the maximum opposite lateral displacement of axis 136 is reached which will occur at 90° after top dead center (see FIG. 12). The actual angle of displacement $\theta$ of cam element 132 is related to the relative magnitudes of the respective radius $R_1$ and $R_2$ by the following formula:

$$\sin \theta = R_1/R_2$$

$R_1$ being the radius between the axis 138 of the crankshaft 82 and axis 136 of eccentric 128 and $R_2$ being the radius between axis 134 of cam element 132 and axis 136 of eccentric 128. Thus as long as $R_2$ is greater than 0 and $R_1$ is less than $R_2$ (which it must be because axis 136 of eccentric 128 cannot practically be positioned on the periphery of the cam member 132) cam member 132 will rotate less that 180°. In order to maintain lateral loading on piston 94 and hence frictional losses at reasonable levels, it is believed preferable to select $R_2$ as being equal to at least $1.75R_1$ or more.

Figure 14:
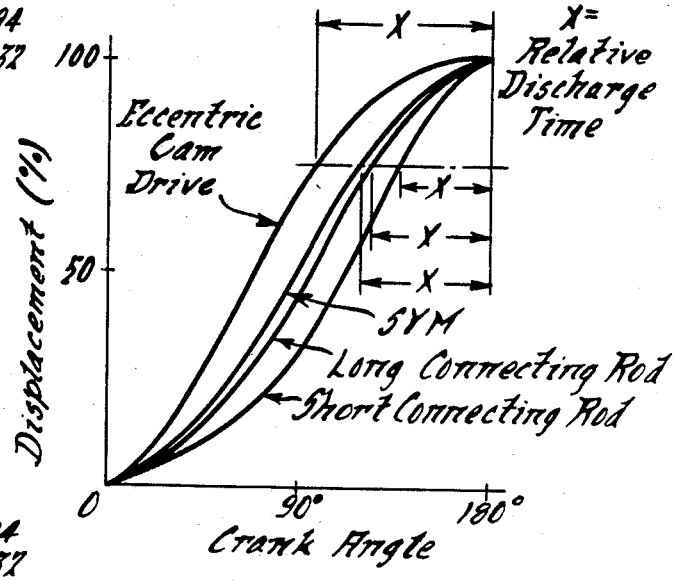
FIG. 14 is a graph showing the percentage of displacement of the piston as a function of the angle of displacement of the crankshaft for driving assembly incorporated in the present invention as compared to other driving arrangements.
Figure 18:
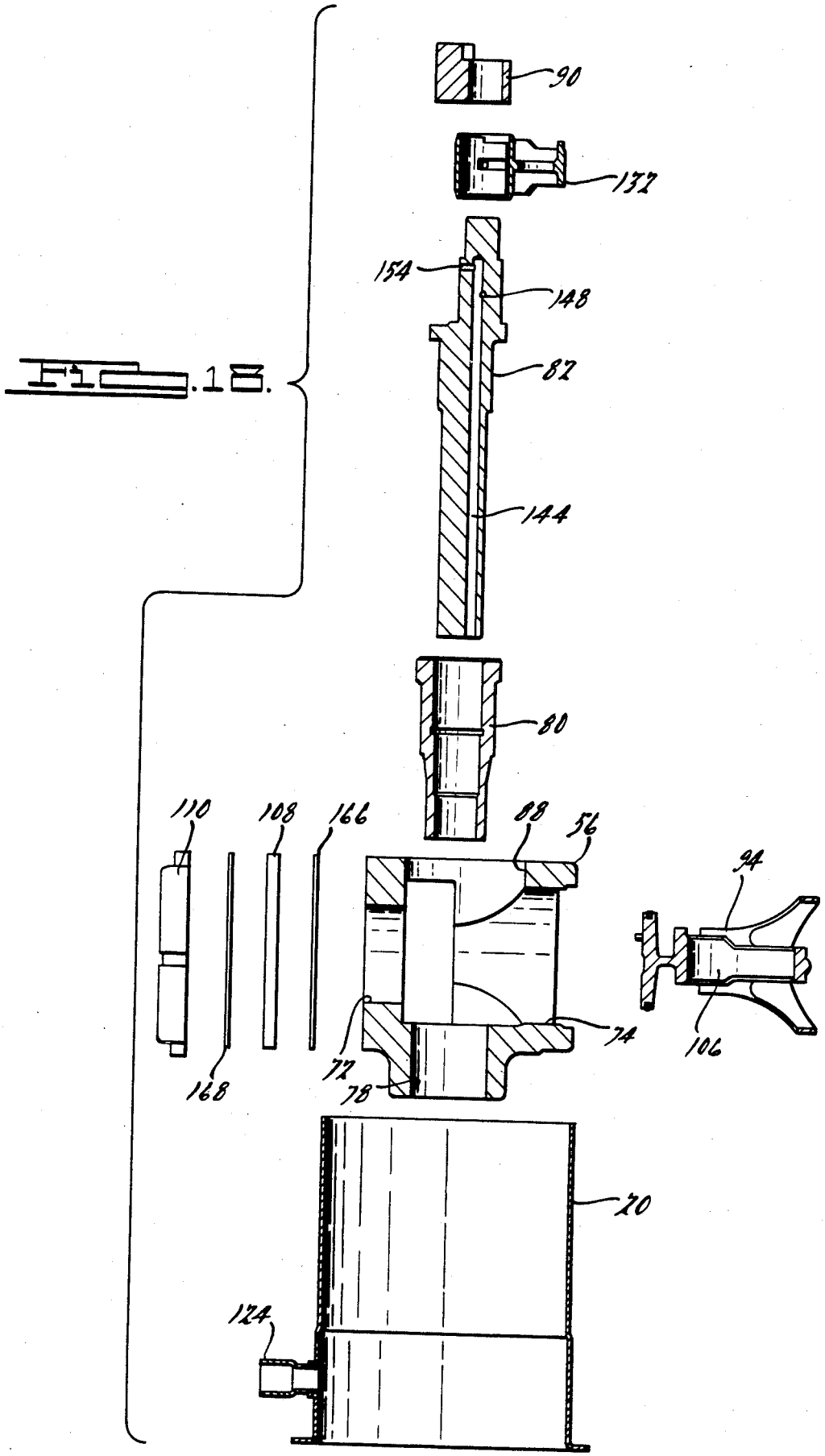
FIG. 18 is an exploded sectioned view of a portion of the motor compressor assembly shown in FIG. 1 illustrating the method of assembling the upper portion thereof in accordance with the present invention.
Figure 19:
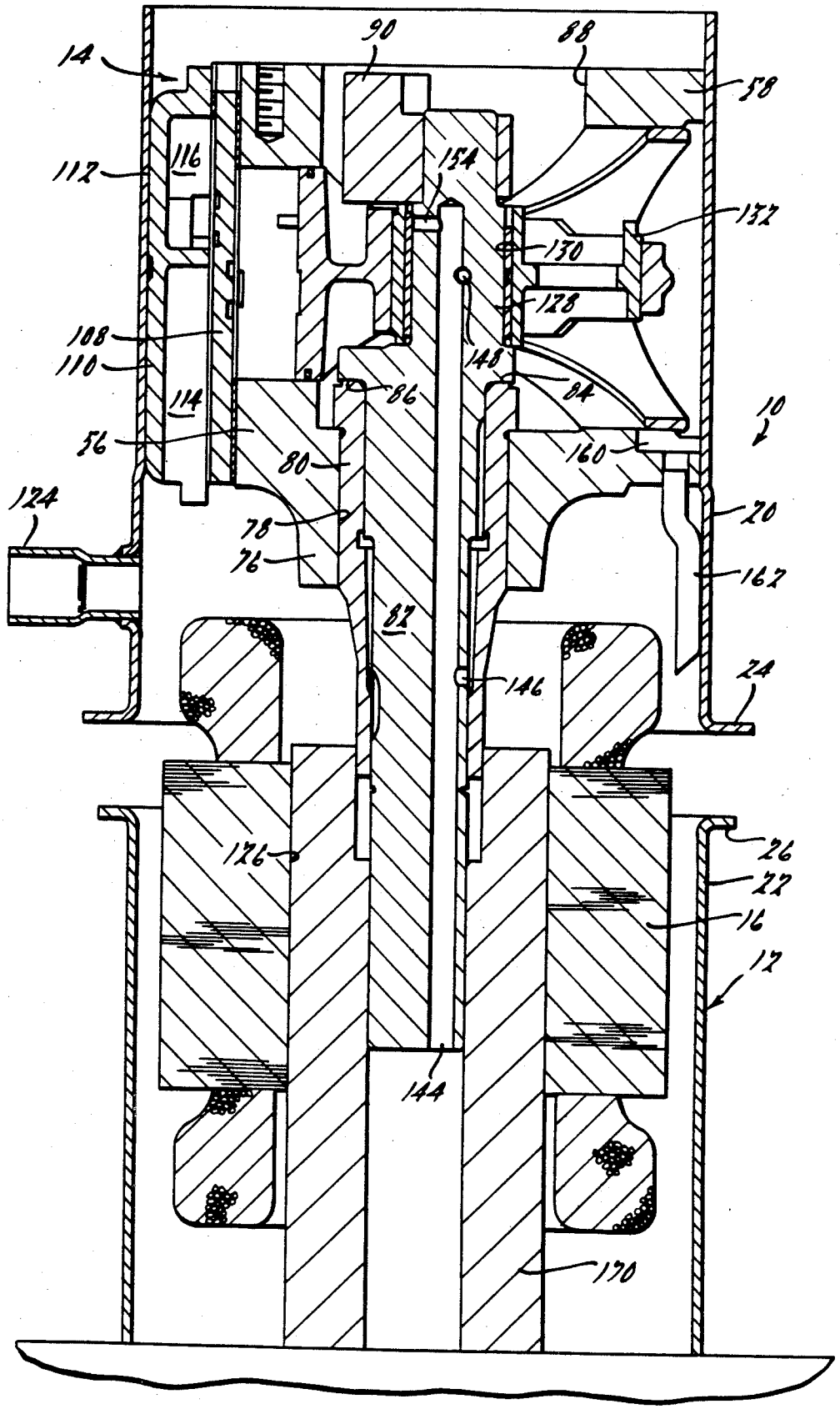
FIG. 19 is an exploded section view of the motor compressor of FIG. 1 illustrating the method of assembling upper and lower subassemblies thereof together all in accordance with the present invention.

Referring now to FIG. 14 wherein the percentage of piston displacement is plotted as a function of angular displacement of the crankshaft for various forms of driving connections, it can be seen that the length of time (which is directly proportional to the degrees of crankshaft rotation) during which the piston is at or beyond 75% of maximum displacement (100% corresponding to top dead center) is significantly greater than encountered with a relatively short convention connecting rod drive arrangement and in fact is also significantly greater than is achieved with relatively long connecting rods or the simple harmonic motion of a scotch yoke mechanisms ("SYM"). Accordingly, it will be appreciated that the use of this cam drive arrangement allows a significantly greater time during which discharge gas may be expelled from the compression chamber while still enabling the maximum dimension of the compressor and head as measured along the line of piston travel to be no greater than the diameter of the stator thereby enabling use of a minimum sized circular outer shell.

In order to provide lubrication for motor compressor 10, an oil sump 140 is provided in the bottom of lower shell portion 22 into which a conical end portion of an oil pickup tube 142 extends. The upper end of oil pickup tube 142 is cylindrical in shape and is secured to and for rotation with the lower end of crankshaft 82. As is well known in the art, centrifugal force imparted to the lubricant within pickup tube 142 due to rotation thereof will operate to pump the lubricant upwardly through an axially extending radially offset oil passage 144 provided in crankshaft 82. Respective generally radially outwardly extending passages 146 and 148 communicating with axial passage 144 operate to conduct lubricant to the main bearing 80 and to the bearing surface between crankshaft eccentric 128 and cam member 132. In order to lubricate the interface between cam member 132 and piston 94, a pair of circumferentially spaced passages 150 and 152 extend outwardly through cam member 132 as shown in FIG. 4.

In order to insure an adquate supply of lubricant is provided particularly to the upper cam bearing surfaces, a vent passage 154 is provided extending radially inwardly from the outer surface of the crankshaft eccentric 128 across the axis to the top of axially extending oil passage 144 adjacent but slightly below the upper end of the cam member 132. A notch 156 is provided at the upper edge of the bearing surface on cam member 132 and extends circumferentially approximately 180° therearound being symmetically disposed about the axis of movement of piston 94 and on the unloaded side of the bearing surface (i.e., the side opposite cylinder 72). Thus, as crankshaft 82 rotates eccentric 128, passage 154 will periodically communicate with notch 156 to thereby vent axially extending passage 144 to the crankcase during that portion of travel of the piston during which the crankcase pressure is at or below its mean pressure. This action will thus subject the upper end of the axial oil passage 144 to a relatively low pressure thereby assisting in the flow of lubricant through axial passage 144. Because vent passage 154 extends across the axis of rotation of the crankshaft, it is unlikely that lubricant will be drawn into the crankcase during normal operation.

In order to prevent an accumulation of lubricant in the crankcase due to leakage from the bearings and/or any lubricant which may be drawn through vent passage 154 as well as to prevent excessive pressure occurring in the crankcase, a lubricant return opening 158 is provided in lower flange 60 of the compressor housing 56. Preferably a relatively small notch or recess 160 is provided surrounding the crankcase side of opening 158 to define a collection sump.

In order to minimize mixing of the lubricant with suction gas as it is being returned to the sump, a tube 162 preferably of plastic is provided extending downwardly from opening 158. A slight bend is provided to position the lower portion of tube 162 against shell 20 and to position the bottom opening thereof directly over one of the passages 122 between stator 16 and shell section 22. As shown, the lower end of tube 162 will be cut at an angle to further aid in directing the returning lubricant against the outer shell 20 and away from the suction gas.

Preferably, opening 158 and tube 162 will have a minimum diameter necessary to accommodate the required flow whereby a minimum pressure differential may be maintained between the crankcase and lower portion of the shell. Additionally, tube 162 will be relatively long as compared to the diameter thereof in order to provide a relatively high dynamic impedance leak.

The present invention also contemplates a unique and novel method by which the various components may be rapidly and easily assembled to form a compact efficient motor compressor. The first step in assembling motor compressor 10 is to finish machine the compressor body and the outside diameter of the main bearing. Once this has been completed, the main bearing 80 is pressed into bore 78 of compressor housing 56. Thereafter, the inside diameter of the bearing 80 is machined to final tolerances and to position the bearing surfaces provided therein in concentric relationship with compressor housing 56.

Next piston 94 is inserted into cylinder 72 through the relatively large diameter bore 74 in the compressor housing after which a subassembly comprising crankshaft 82, cam member 132 and counterweight 90 is inserted through respective bores 88 and 106 in the compressor housing and rod portion of piston 94.

The next step is to assemble the valve plate assembly 108 and head 110 to the compressor housing 56. In order to accomplish this and to insure a minimum reexpansion volume between the piston and valve plate assembly, it is first necessary to advance piston 94 to top dead center at which point the piston will project a slight distance P beyond surface 164 of the housing 56. This distance P is then measured and added to a predetermined desired clearance to be provided between the top of piston 94 and valve plate 108 (typically on the order of 0.006"). This sum provides the required thickness G of gasket 166 to be positioned between housing 56 and the valve plate 108.

Next the diameter A of the housing is measured along a line extending generally transverse to the direction of travel of piston 94. Also the maximum width B of compressor housing 56 is measured in the direction of piston travel. To this figure B, the thickness G of gasket 166, the thickness C of the valve plate 108 and maximum thickness D of the head 110 are added. This sum (G+B+C+D) is then subtracted from dimension A. In order to assure a tight clamping action, it is preferble to have the overall dimension of the compressor 14 in the direction of piston travel be slightly greater than diameter A. Hence a predetermined figure, typically 0.006", is added to the difference between A and G+B+C+D. The result is the required thickness T of the head gasket 168 to be positioned between valve plate 108 and head 110.

Now that the required gasket thickness has been selected, the valve assembly is installed on the housing by first inserting the suction reed valve pin and locating pins (not shown) into suitable openings provided on surface 164 of housing 56. Preselected valve plate gasket 166 is then placed on the housing positioned by the locating pins, followed by the suction reed and valve plate 108. The discharge valve pins, discharge valve and backer (not shown) are then assembled to valve plate 108, followed by the preselected head gasket 168. The head 110 is then positioned on housing 56, the resulting assembly clamped together and press fitted into upper shell section 20.

Stator 16 is pressed into lower shell section 22 and the two shell sections are ready to be joined. In order to accurately position crankshaft 82 in true coaxial relationship with the rotor receiving bore in stator 16, a locating mandrel 170 is inserted into the bore between stator 16 and crankshaft 82. In order to allow for adjustment to obtain proper alignment of crankshaft 82, a slight clearance may exist between respective flanges 24 and 26 around all or a portion of the periphery of the respective shell sections 20 and 22. Next flanges 24 and 26 are tack welded at opposite sides, the assembly indexed 90° and flanges 24 and 26 tack welded at opposite sides again to lock the assembly in position. The entire peripheries of the flanges are then welded together.

A thrust washer 172 and associated retainer 174 are assembled to crankshaft 82 after which rotor 18 is heat shrunk thereon. Oil pickup tube 142 is pressed onto the crankshaft and shell bottom 28 is then welded to the lower end of the lower shell section 22.

Next a pair of annular gaskets 176 and 178 are positioned around each of the discharge passages 50 and 52 opening outwardly from top flange 58 of the compressor housing 56, after which lower section 44 of discharge muffler 32 is secured thereto by a plurality of bolts 54. Discharge muffler baffle 48 is then secured to the assembly by means of nuts 180 followed by assembly of the upper muffler section 34, whereupon the upper and lower muffler sections are simultaneously welded together and to the upper end of the upper shell section 20. The center portions of the discharge muffler sections 34 and 44 are also welded together thereby completing the assembly.

The resulting compressor thus provides an extremely compact, easily assembled hermetic motor compressor requiring a minimum number of parts and only three separate fasteners to retain the same in assembled operating condition.

Referring now to FIGS. 21 and 22, there is illustrated an alternative to the above described rotary valve used to aid the oil pump in circulating lubricant to the bearings. In this embodiment, a second axially extending vent passage 182 of a smaller diameter is provided as a radially inwardly disposed continuation of passage 144 and opening outwardly through the top of crankshaft so as to place passage 144 in continuous communication with the crankcase. In order to maintain the pressure within the crankcase at or below the suction pressure within the motor compartment, a pair of openings 184 and 186 are provided in lower flange 60 of housing 56 with a pressure responsive reed valve 188 secured at one end in overlying relationship thereto. Thus, as piston 94 moves back toward the crankcase on a suction stroke, the resulting increasing pressure in the crankcase will be vented through the openings 184, 186. Thereafter, as piston 94 moves away from the crankcase on a compression stroke, the valve 188 will close and the resulting pressure in the crankcase will drop. Additionally, any excess oil in the crankcase will also be returned through openings and accordingly a baffle member 190 is provided to direct this returning oil through passage 122 between shell 22 and the stator 16 to the sump 140, thereby minimizing the mixing of lubricant and suction gas. Preferably, openings 184 and 186 will be relatively large so as to provide a substantial cross sectional area for venting the crankcase which may become important should the discharge muffler pressure relief valve open and vent discharge gas into the crankcase.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A hermetic refrigeration compressor comprising:

a first shell section;

a compressor assembly including a compressor housing fixedly supported within said first shell section, said compressor housing including a rotatable drive shaft extending outwardly from one end of said first shell section; and a second shell section;

an electric driving motor assembly including a stator fixedly supported within said second shell section, said stator having a rotor receiving bore extending therethrough and a rotor supported on said drive shaft within said bore;

said first and second shell sections being radially positioned with respect to each other whereby said rotor is coaxially positioned within said bore to thereby provide a uniform air gap between said rotor and said stator said sections being welded together in said position, said weld being the sole means for preventing relative radial movement between said compressor housing fixedly supported in said first shell section and said stator fixedly supported in said second shell section and hence maintaining said uniform air gap.

2. A hermetic refrigeration compressor as set forth in claim 1 wherein said first and second shells each include a generally radially outwardly extending annular flange portion, said flange portions being welded together.

3. A hermetic refrigeration compressor as set forth in claim 2 wherein said flange portions define a slight gap therebetween around a portion of the periphery, said welding filling said gap so as to sealingly secure said flanges together.

4. A method of assembling a hermetic refrigeration compressor comprising:

positioning a first shell section containing a compressor in aligned end to end relationship with a second shell section containing a stator;

aligning radially said first shell section with respect to said second shell section whereby a rotor receiving crankshaft is positioned in coaxial relationship within a rotor receiving bore of said stator; and thereafter welding said ends of said first and second shell sections together to lock said crankshaft receiving rotor in said coaxial postion whereby a uniform air gap will be provided between the rotor and said stator.

5. A method as set forth in claim 4 wherein said aligning may create slight gaps along peripheral portions of said ends, said welding being operative to fill said gaps.

6. A method as set forth in claim 4 further comprising forming radially outwardly extending flanges on said one ends of said first and second shell sections, said flanges being operative to inhibit distortion of said shell sections resulting from heating during welding of said shell sections together.

7. A method of assembling a hermetic motor compressor wherein said motor compressor includes a compressor assembly fixedly secured within a first shell section and a stator fixedly secured within a second shell section, said method comprising:

placing said second shell section on a mandrel having a portion extending into a rotor receiving bore in said stator;

placing one end of said first shell section in axially aligned relationship with one end of said second shell section, said first shell section having a crankshaft extending outwardly from said one end and being received within a bore in said mandrel, said mandrel being operative to effect a radial shifting of said first shell section to precisely position said crankshaft in coaxial relationship with said stator bore, whereby upon assembly of a motor rotor a uniform air gap will be provided around the periphery thereof; and tack welding said ends of said first and second shell sections together at a plurality of locations to lock said shell sections together with said crankshaft in aligned coaxial relationship with respect to said bore; and thereafter welding the periphery of said shell to seal said one ends together.

8. A method as set forth in claim 7 further comprising forming radially outwardly extending flanges on said one ends of said first and second shell sections, said flanges being operative to inhibit distortion of said shell sections resulting from heating during welding of said shell sections together.

9. A method as set forth in claim 8 wherein shell sections are positioned with said flanges abutting each other at at least one peripheral location when said crankshaft is axially aligned with said bore.

10. A method as set forth in claim 7 wherein said ends are tack welded at dimetrically opposite sides of said one ends substantially simultaneously.

11. A method as set forth in claim 10 wherein said first and second shell sections are further tack welded on diametrically opposite sides, said further tack welds being spaced approximately 90° from said tack welds.

* * * * *